US009692152B2

(12) United States Patent
Daily et al.

(10) Patent No.: US 9,692,152 B2
(45) Date of Patent: Jun. 27, 2017

(54) WALL PLATE CONNECTOR SYSTEM

(71) Applicant: TYCO ELECTRONICS CORPORATION, Berwyn, PA (US)

(72) Inventors: Christopher George Daily, Harrisburg, PA (US); Matthew Edward Mostoller, Hummelstown, PA (US); Edward John Howard, Millersburg, PA (US)

(73) Assignee: TE Connectivity Corporation, Berwyn, PA (US)

( * ) Notice: Subject to any disclaimer, the term of this patent is extended or adjusted under 35 U.S.C. 154(b) by 0 days.

(21) Appl. No.: 14/940,923

(22) Filed: Nov. 13, 2015

(65) Prior Publication Data

US 2017/0141491 A1 May 18, 2017

(51) Int. Cl.
*H01R 9/22* (2006.01)
*H01R 9/24* (2006.01)

(52) U.S. Cl.
CPC ..... *H01R 9/2416* (2013.01)

(58) Field of Classification Search
CPC ..... H01R 9/2416
USPC ..... 439/709, 441
See application file for complete search history.

(56) References Cited

U.S. PATENT DOCUMENTS 7,029,336 B2 * 4/2006 Cox ..... H01R 4/38 439/709
2013/0029529 A1 1/2013 Osagie et al.

FOREIGN PATENT DOCUMENTS

WO 00/30220 A1 5/2000
WO 2012/136536 A1 10/2012

OTHER PUBLICATIONS

International Search Report, International Application No. PCT/US2016/060899, International Filing Date, Nov. 8, 2016.

* cited by examiner

*Primary Examiner* — Javaid Nasri

(57) ABSTRACT

A wall plate connector system includes a wall plate terminal block extending from a wall plate base. The wall plate terminal block includes a terminal block body having a front, a rear, a first end and a second end. The terminal block body has contact channels and wire channels open to corresponding contact channels to receive electrical wires during a poke-in termination. Terminal contacts are received in corresponding contact channels and each include a poke-in spring beam and a header beam. A header assembly is removably coupled to the wall plate terminal block and includes header contacts configured to be terminated to a control circuit board. Each header contact has a mating beam. At least one of the mating beam and the header beam is a resiliently deflected spring beam configured for repeated mating and unmating at separable mating interfaces.

20 Claims, 8 Drawing Sheets

WALL PLATE CONNECTOR SYSTEM

BACKGROUND OF THE INVENTION

The subject matter described herein relates generally to a wall plate connector system.

Wall plate connector systems are used in various applications such as industrial machines, home automation, and the like. For example, wall plate connector systems provide a wall plate having electrical wiring associated with the wall terminated to contacts, such as via screw terminals. A wall plate cover device is attached to the wall plate and contacts. The wall plate cover device includes a circuit board electrically connected to the contacts, and thus the wiring, for control of the wall plate connector system. For example, the wall plate connector system may be a thermostat, smoke detector, security system panel or other type of home automation device. Typically, the circuit board includes contact pins that are soldered to and extend from the circuit board. The ends of the pins are configured to be plugged into the wall plate for electrical connection to the contacts.

However, known systems are not without disadvantages. For example, the pins are susceptible to damage, such as during shipping or if the device is dropped. The pins are exposed and susceptible to bending, breaking, separating from the circuit board, or other damage. Additionally, connecting the wires to the screw terminals may be time consuming, particularly as devices become more complex and more wires are provided for termination. Additionally, the solder pins are typically through-hole terminated to the circuit board. The circuits of the circuit board must be routed around the through holes, and as the devices become more complex, more circuits are provided, making routing difficult and/or requiring more layers of the circuit board, which increases the cost of the overall device.

SUMMARY OF THE INVENTION

In an embodiment, a wall plate connector system is provided including a wall plate base configured to be mounted to a wall having electrical wires associated with the wall and a wall plate terminal block extending from the wall plate base. The wall plate terminal block includes a terminal block body having a front, a rear, a first end between the front and the rear and a second end between the front and the rear generally opposite the first end. The terminal block body has contact channels and wire channels open to corresponding contact channels. The wire channels are open at the front to receive one of the electrical wires during a poke-in termination. Terminal contacts are received in corresponding contact channels and held by the housing. Each terminal contact includes a poke-in spring beam configured to engage the electrical wire when poked-in to the corresponding wire channel. Each terminal contact includes a header beam remote from the poke-in spring beam having a separable mating interface. A header assembly is removably coupled to the wall plate terminal block. The header assembly has a control circuit board for controlling the wall plate connector system. The header assembly has header contacts terminated to the control circuit board. Each header contact has a mating beam having a separable mating interface mated to the separable mating interface of the header beam of the corresponding terminal contact. At least one of the mating beam and the header beam is a resiliently deflected spring beam configured for repeated mating and unmating at the separable mating interfaces.

In another embodiment, a wall plate connector system is provided including a wall plate base configured to be mounted to a wall having electrical wires associated with the wall and a wall plate terminal block extending from the wall plate base. The wall plate terminal block includes a terminal block body having a front, a rear, a first end between the front and the rear and a second end between the front and the rear generally opposite the first end. The terminal block body has contact channels and wire channels open to corresponding contact channels open at the front to receive a corresponding one of the electrical wires during a poke-in termination. Terminal contact assemblies are received in corresponding contact channels and held by the housing. Each terminal contact assembly includes a terminal contact and a pivot lever holding the terminal contact. The pivot lever is pivotably coupled to the terminal block body. The pivot lever has a release button exposed at an exterior of the terminal block body. The terminal contact includes a poke-in spring beam configured to engage the electrical wire when poked-in to the corresponding wire channel. The poke-in spring beam is releasable from the electrical wire when the pivot lever is moved to a releasing position. Each terminal contact includes a header beam remote from the poke-in spring beam. The header beam has a separable mating interface. A header assembly is removably coupled to the wall plate terminal block. The header assembly has a control circuit board for controlling the wall plate connector system. The header assembly has header contacts terminated to the control circuit board. Each header contact has a mating beam. The mating beam has a separable mating interface mated to the separable mating interface of the header beam of the corresponding terminal contact. At least one of the mating beam and the header beam is a resiliently deflected spring beam configured for repeated mating and unmating at the separable mating interfaces.

In a further embodiment, a wall plate connector system includes a wall plate base configured to be mounted to a wall having electrical wires associated with the wall. A wall plate terminal block extends from the wall plate base. The wall plate terminal block includes a terminal block body having a front, a rear, a first end between the front and the rear and a second end between the front and the rear generally opposite the first end. The terminal block body has contact channels and wire channels open to corresponding contact channels. The wire channels are open at the front to receive a corresponding one of the electrical wires during a poke-in termination. Terminal contact assemblies are received in corresponding contact channels and held by the housing. Each terminal contact assembly includes a terminal contact and a pivot lever holding the terminal contact. The pivot lever is pivotably coupled to the terminal block body. The pivot lever has a release button extending from the rear and being movable to move the terminal contact between a capturing position and a releasing position. The terminal contact includes a poke-in spring beam configured to engage the electrical wire when poked-in to the corresponding wire channel and when in the capturing position. The poke-in spring beam is releasable from the electrical wire when the pivot lever is moved to the releasing position. Each terminal contact includes a header beam remote from the poke-in spring beam. The header beam has a separable mating interface configured for mating with a header contact of a header assembly.

DETAILED DESCRIPTION OF THE DRAWINGS

Figure 1:
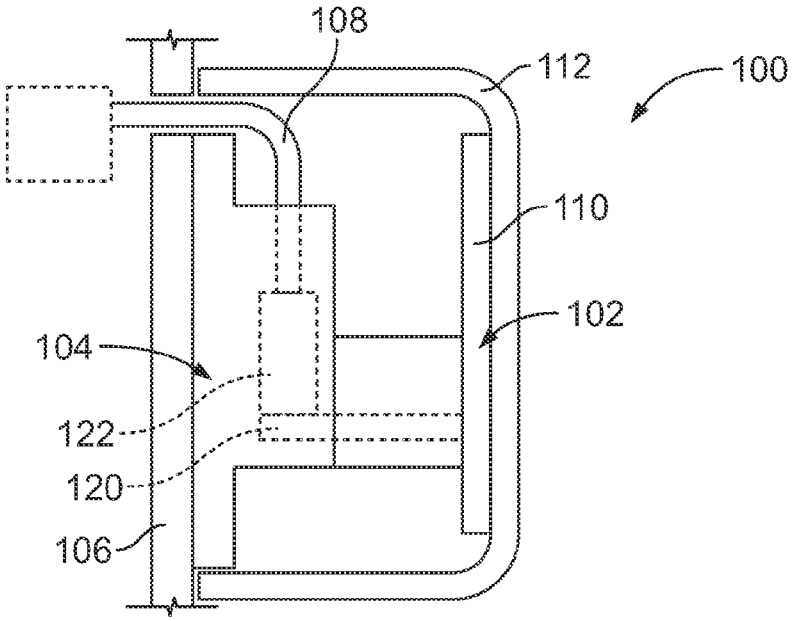
FIG. 1 is a schematic view of an embodiment of a wall plate connector system in accordance with an exemplary embodiment.

FIG. 1 is a schematic view of an embodiment of a wall plate connector system 100 in accordance with an exemplary embodiment. The wall plate connector system 100 includes a control device 102 and an electrical connector 104. The electrical connector 104 is configured to be mounted to a wall 106. The wall 106 may be a building wall, such as in a home or office. The wall 106 may be a ceiling, a floor, a piece of furniture, a fixture, another structure, and/or the like. In other various embodiments, the wall 106 may be a wall of a component or machine, such as in an industrial application. Electrical wires 108 associated with the wall 106 may be terminated to the electrical connector 104. For example, the wires 108 may be routed behind the wall 106 and pass through the wall 106 for termination to the electrical connector 104. The wires 108 may be routed along the wall 106 to the electrical connector 104. The wires 108 may be part of a home automation system. The wires 108 may be routed to another component, such as an appliance.

The control device 102 is configured to be mounted to the electrical connector 104 such that the electrical connector 104 is electrically connected with the control device 102 and the control device 102 is then mounted to the wall 106. Optionally, the control device 102 may be a user interface. The control device 102 may include a display, one or more buttons or touch pads, and the like. The control device 102 may be a control device of an industrial machine, a vehicle or another component. The control device 102 may be part of a home automation system. For example, the control device 102 may be a thermostat, a smoke detector, a security system panel, an audio or video component, a docking station for a portable electronic device, and the like. In an exemplary embodiment, the control device 102 includes a control circuit board 110 for controlling one or more functions or components of the wall plate connector system 100. For example, the control device 102 may control an appliance or another electronic system. The control device 102 may include other components associated with and/or mounted to the control circuit board 110, such as a controller, a processor, a memory, a communication device, a display, a user input, and the like. The control device 102 may include a cover 112 or other housing that holds the control circuit board 110 and other components.

The control device 102 includes mating contacts 120 configured to be electrically connected with terminal contacts 122 of the electrical connector 104. As will be described below, the mating contacts 120 and the terminal contacts 122 are configured to be mated at separable mating interfaces to establish an electrical connection therebetween, such electrical connection being repeatably mated and unmated to allow the control device 102 to be repeatably mated to and unmated from the electrical connector 104. For example, the mating contacts 120 may be plugged into the electrical connector 104 for mating with the terminal contacts 122 held in the electrical connector 104. The electrical connector 104 electrically connects the electrical wires 108 with the control circuit board 110 of the control device 102 via the terminal contacts 122 and the mating contacts 120.

Figure 2:
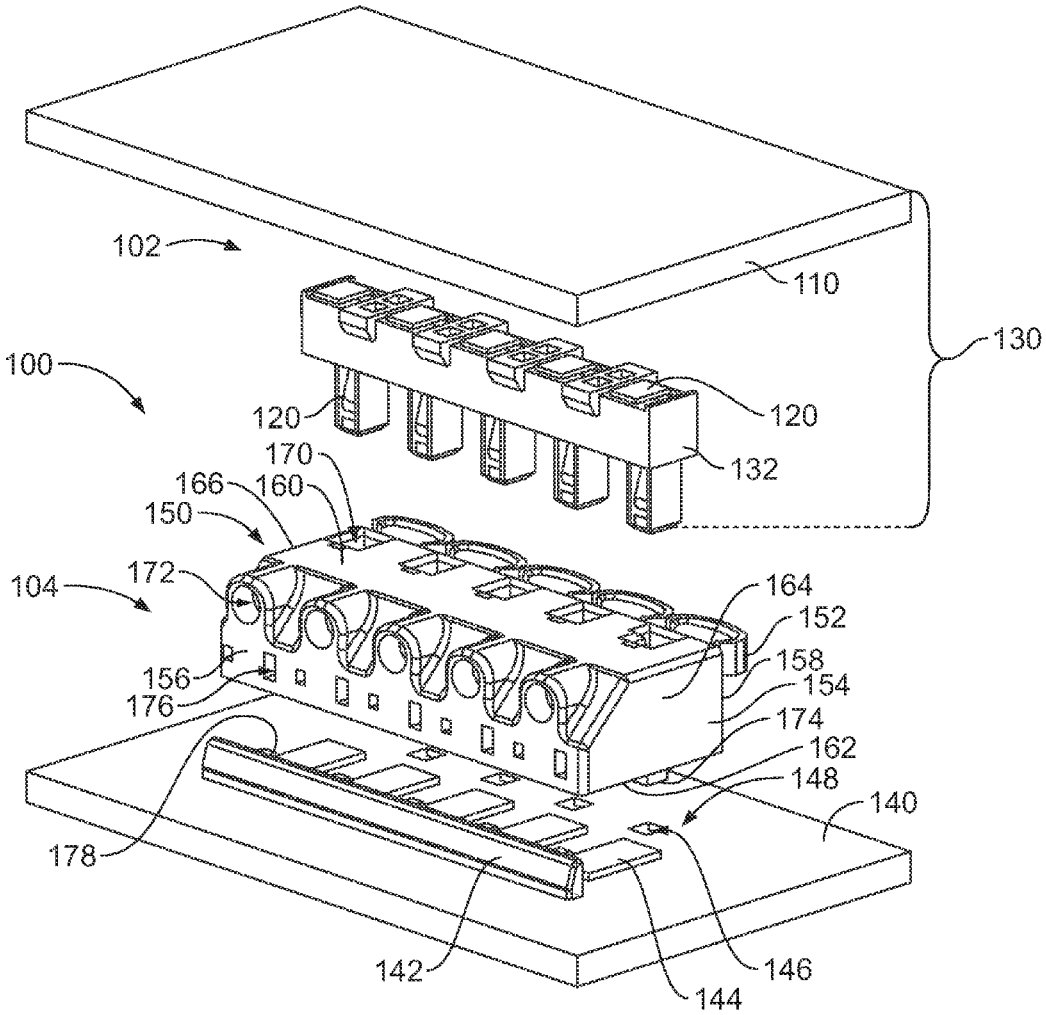
FIG. 2 is an exploded view of the wall plate connector system in accordance with an exemplary embodiment.

FIG. 2 is an exploded view of the wall plate connector system 100 in accordance with an exemplary embodiment. The control device 102 includes a header assembly 130 configured to be removably coupled to the electrical connector 104. The control circuit board 110 is part of the header assembly 130. The header assembly 130 includes a header block 132 that holds the mating or header contacts 120. The header block 132 may be manufactured from a dielectric material, such as a plastic material. The header block 132 may be a molded block having features for mounting to the control circuit board 110, features for mating with the electrical connector 104 and features for holding the header contacts 120.

The electrical connector 104 includes a wall plate base 140 configured to be mounted to the wall 106 (shown in FIG. 1). The wall plate base 140 may be generally planar and include an interior surface configured to be mounted to the wall 106 and an exterior surface facing the control device 102. The wall plate base 140 may be secured to the wall 106 by fasteners, such as screws. In an exemplary embodiment, the wall plate base 140 includes a support wall 142 extending from the exterior surface. The wall plate base 140 includes support pads 144 extending from the exterior surface. The wall plate base 140 includes a plurality of openings 146 extending therethrough. The support wall 142, support pads 144 and openings 146 are arranged in a mating area 148 of the wall plate base 140.

The electrical connector 104 includes a wall plate terminal block 150 extending from the wall plate base 140. In the illustrated embodiment, the wall plate terminal block 150 is separate and discrete from the wall plate base 140 and is configured to be mounted to the wall plate base 140. In alternative embodiments, the wall plate terminal block 150 may be integral with the wall plate base 140. The wall plate terminal block 150 holds the terminal contacts 122 (shown in FIG. 1). In an exemplary embodiment, the wall plate terminal block 150 is configured to hold a plurality of the terminal contacts 122. The wires 108 (shown in FIG. 1) are configured to be connected to the electrical connector 104 at the wall plate terminal block 150. For example, the wires 108 may be poked into the wall plate terminal block 150. In an exemplary embodiment, the wall plate terminal block 150 includes pivot levers 152 for releasing the wires 108 from the wall plate terminal block 150.

The wall plate terminal block 150 includes a terminal block body 154 manufactured from a dielectric material, such as a plastic material. The terminal block body 154 may be a molded block having features for mounting to the wall plate base 140, features for mating with the header assembly 130, and features for holding the terminal contacts 122. The terminal block body 154 has a front 156 and a rear 158 generally opposite the front 156. The terminal block body 154 has a first end 160 between the front 156 and the rear 158 and a second end 162 between the front 156 and the rear 158 generally opposite the first end 160. The terminal block body 154 has a first side 164 between the front 156 and the rear 158 and a second side 166 between the front 156 and the rear 158 generally opposite the first side 164. The terminal block body 154 may have other sides or ends in alternative embodiments to provide a different shaped body.

The terminal block body 154 has contact channels 170 that receive corresponding terminal contacts 122 and wire channels 172 open to the corresponding contact channels 170 that receive corresponding wires 108. In the illustrated embodiment, the wire channels 172 are open at the front 156. The pivot levers 152, used to release the wires 108, are provided at the rear 158. The contact channels 170 are open at the first end 160 for receiving the header assembly 130 and corresponding header contacts 120. The terminal block body 154 is configured to be mounted to the wall plate base 140 at the second end 162. Other arrangements and positions of the components of the wall plate terminal block 150 are possible in alternative embodiments.

In an exemplary embodiment, the terminal block body 154 includes latches 174 extending from the second end 162 that are configured to be received in corresponding openings 146 in the wall plate base 140 to secure the terminal block body 154 to the wall plate base 140. Optionally, the terminal block body 154 may include windows 176 at the front 156 configured to receive tabs 178 extending from the support wall 142. The tabs 178 may be used to align the terminal block body 154 with the wall plate base 140, such as to align the latches 174 with the openings 146 and/or to align the terminal contacts 122 with the corresponding support pads 144. Optionally, the windows 176 may be slightly larger than the tabs 178 to allow a limited amount of floating movement of the wall plate terminal block 150 with respect to the wall plate base 140, such as for alignment. Optionally, the tabs 178 may be keyed or polarized to assure proper alignment of the wall plate terminal block 150 to the wall plate base 140. Other types of keying features may be provided in alternative embodiments.

Figure 3:
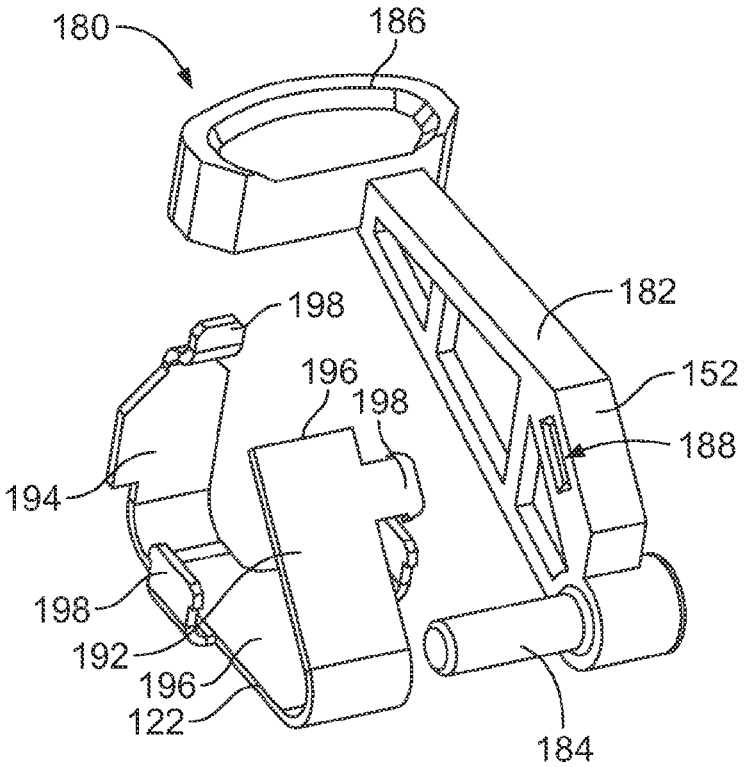
FIG. 3 is an exploded view of a terminal contact assembly of the wall plate connector system in accordance with an exemplary embodiment.

FIG. 3 is an exploded view of a terminal contact assembly 180 in accordance with an exemplary embodiment. The terminal contact assembly 180 includes the pivot lever 152 and the terminal contact 122. The terminal contact 122 may be coupled to the pivot lever 152 to release the terminal contact 122 from the wire 108 (shown in FIG. 1). The pivot lever 152 includes a main body 182 having a pivot axle 184 at or near one end of the main body 182 and a release button 186 at or near the opposite end of the main body 182. The release button 186 is configured to be located exterior of the terminal block body 154 (shown in FIG. 2) for actuation by a user to release the terminal contact 122. The pivot axle 184 is configured to be held in the terminal block 150 and the pivot lever 152 may be pivoted about the pivot axle 184. In an exemplary embodiment, the main body 182 includes at least one slot 188 that receives a portion of the terminal contact 122 to tie the terminal contact 122 to the main body 182. As such, the terminal contact 122 may be moved with the pivot lever 152.

The terminal contact 122 includes a base 190 having a poke-in spring beam 192 extending from one end of the base 190 and a header beam 194 extending from an opposite end of the base 190. The terminal contact 122 may be a stamped and formed terminal contact stamped from a sheet of metal material and formed into a predetermined shape. In the illustrated embodiment, the header beam 194 extends generally perpendicular to the base 190. The poke-in spring beam 192 is folded over at an angle relative to the base 190. For example, the poke-in spring beam 192 may be bent greater than 90° such that the poke-in spring beam 192 extends in a direction toward the header beam 194. The poke-in spring beam 192 is folded over the base 190. The poke-in spring beam 192 extends to a tip 196. The tip 196 defines an interface for the terminal contact 122 with the corresponding wire 108 (shown in FIG. 1). The tip 196 may dig into the wire 108 when the wire 108 is poked into the wall plate terminal block 150 to secure the wire 108 in the wall plate terminal block 150. The tip 196 may be released from the wire 108 when the pivot lever 152 is actuated.

In an exemplary embodiment, the terminal contact 122 includes one or more barbs 198 extending therefrom. The barbs 198 may be used to secure the terminal contact 122 to the pivot lever 152 and/or to the terminal block body 154. For example, one of the barbs 198 may extend from the poke-in spring beam 192 and may be received in the slots 188 to secure the poke-in spring beam 192 to the pivot lever 152. As such, the poke-in spring beam 192 may be movable with the pivot lever 152, such as to release the poke-in spring beam 192. Other barbs 198 may be used to secure other portions of the terminal contact 122 to the terminal block body 154. For example, the base 190 may have one or more barbs 198 extending therefrom. The header beam 194 may have one or more barbs 198 extending therefrom.

Figure 4:
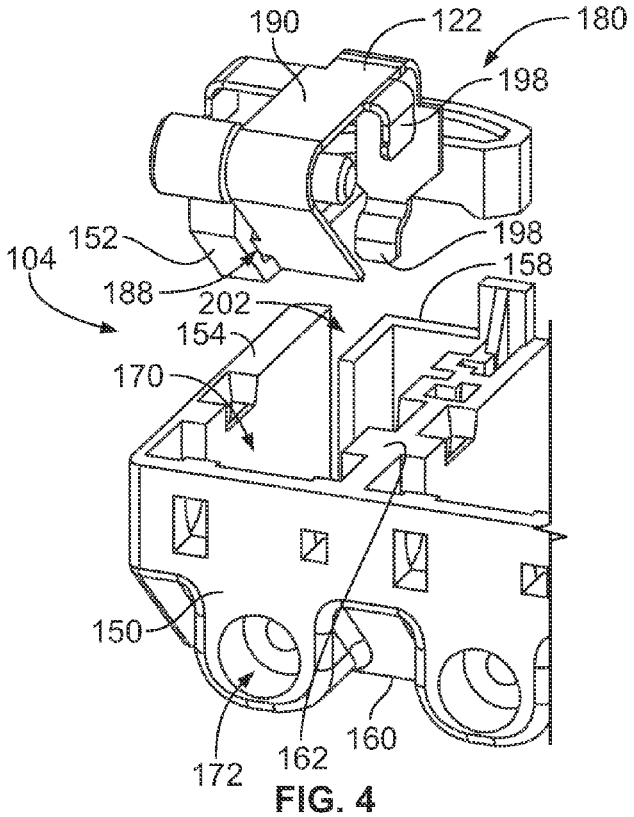
FIG. 4 is a bottom perspective view of an electrical connector of the wall plate connector system.
Figure 5:
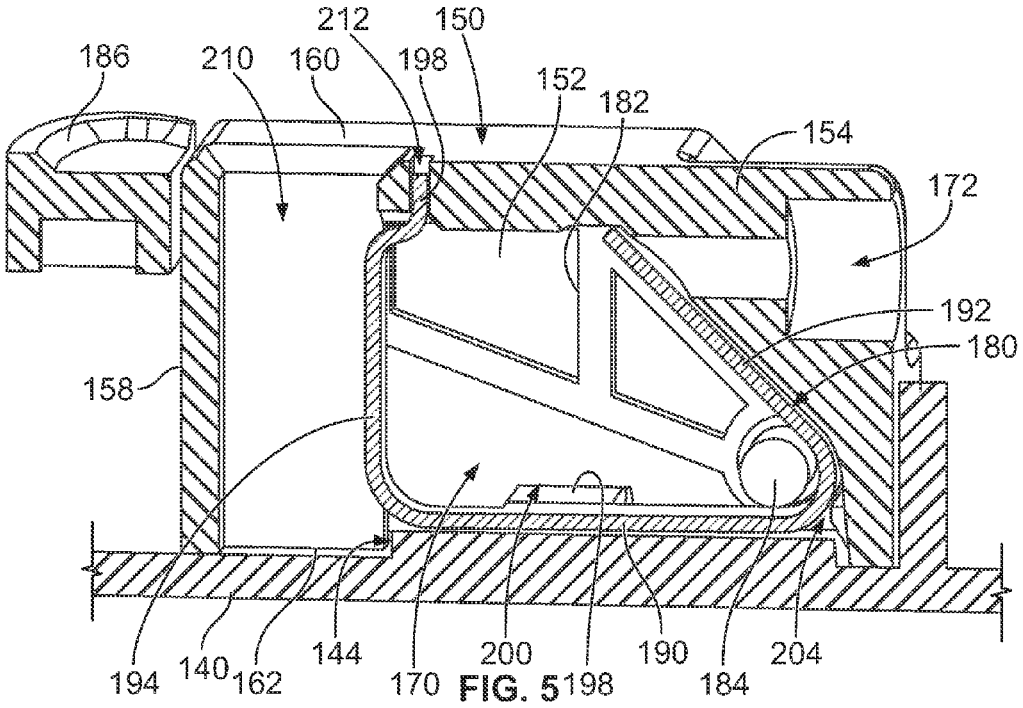
FIG. 5 is a cross-sectional view of a portion of the electrical connector.

FIG. 4 is a bottom perspective view of the electrical connector 104 showing one of the terminal contact assemblies 180 poised for loading into the wall plate terminal block 150. FIG. 5 is a cross-sectional view of a portion of the electrical connector 104 showing one of the terminal contact assemblies 180 loaded in the wall plate terminal block 150 relative to the wall plate base 140.

The terminal contact 122 may be attached to the pivot lever 152 prior to loading into the contact channel 170 through the second end 162 of the terminal block body 154. The terminal contact 122 and the pivot lever 152 may be loaded into the wall plate terminal block 150 as a unit. The poke-in spring beam 192 wraps around the pivot axle 184 such that the pivot axle 184 is positioned between the poke-in spring beam 192 and the base 190. The barb 198 extending from the poke-in spring beam 192 is received in the slot 188 to tie the terminal contact 122 to the pivot lever 152. The other barbs 198, such as the barbs 198 extending from the base 190 and/or the header beam 194 are aligned with pockets 200 formed in the terminal block body 154. The barbs 198 are received in the corresponding pockets 200 to secure the terminal contact 122 to the terminal block body 154. The barbs 198 may be held in the pockets 200 by an interference fit. The barbs 198 may dig into the plastic material of the terminal block body 154 to secure the terminal contact 122 in the contact channel 170.

The terminal block body 154 includes a lever groove 202 open through the rear 158. The main body 182 of the pivot lever 152 passes through the lever groove 202 such that the release button 186 is positioned behind the rear 158 and is accessible from the exterior of the wall plate terminal block 150. The terminal block body 154 includes a lever axle slot 204 that receives the pivot axle 184. The pivot axle 184 may snap into the lever axle slot 204 such that the terminal block body 154 holds the pivot axle 184 therein. The pivot axle 184 may be pivotable within the lever axle slot 204 to allow the pivot lever 152 to rotate or pivot between an un-actuated position and an actuated position. Optionally, both ends of the pivot axle 184 may be received in the lever axle slot 204. The ends of the pivot axle 184 may have different diameters and the lever axle slot 204 may be sized appropriately to receive the different diameter ends of the pivot axle 184.

The terminal block body 154 includes a plurality of header channels 210 extending therethrough. In an exemplary embodiment, the header channels 210 are open at the first end 160 to receive a portion of the header assembly 130 (shown in FIG. 2). The header beam 194 of the terminal contact 122 may be positioned adjacent to, and at least partially received in, the header channel 210. As such, when the header assembly 130 and header contact 120 (shown in FIG. 1) are received in the corresponding header channel 210, the header contact 120 may be electrically connected to the header beam 194 of the terminal contact 122. In an exemplary embodiment, the terminal block body 154 includes a header beam slot 212 formed therein. The end of the header beam 194 and/or one of the barbs 198 may be received in the header beam slot 212. As such, the distal end of the header beam 194 may be captured in the header beam slot 212. The header beam 194 may thus be fixed between the header beam slot 212 and the base 190, with the base 190 being secured using the barbs 198 received in the pockets 200.

The poke-in spring beam 192 is positioned in the contact channel 170 generally behind the wire channel 172. When the wire 108 is poked into the wire channel 172, the wire 108 may be mechanically and electrically connected to the poke-in spring beam 192. Optionally, the poke-in spring beam 192 may be automatically deflected by the wire 108 as the wire 108 is poked into the wire channel 172. For example, the wire 108 may force the poke-in spring beam 192 to flex as the wire 108 is poked into the terminal block 150. The pivot lever 152 may be pivoted with the poke-in spring beam 192 as the wire 108 is loaded into the terminal block 150. Optionally, the pivot lever 152 may be manually actuated by the user by pressing downward on the release button 186, which may force the poke-in spring beam 192 to be flexed open allowing the wire 108 to poke-into the terminal block 150.

The base 190 may extend along and be supported by the support pad 144 (FIG. 5). For example, the support pad 144 may extend at least partially into the terminal block 150, such as through the second end 162. When the poke-in spring beam 192 is flexed, the base 190 may remain rigid or unflexed against the support pad 144. As such, most or all of the bending moment is transferred into the poke-in spring beam 192 causing the poke-in spring beam 192 to have a greater spring force against the wire 108.

Figure 6:
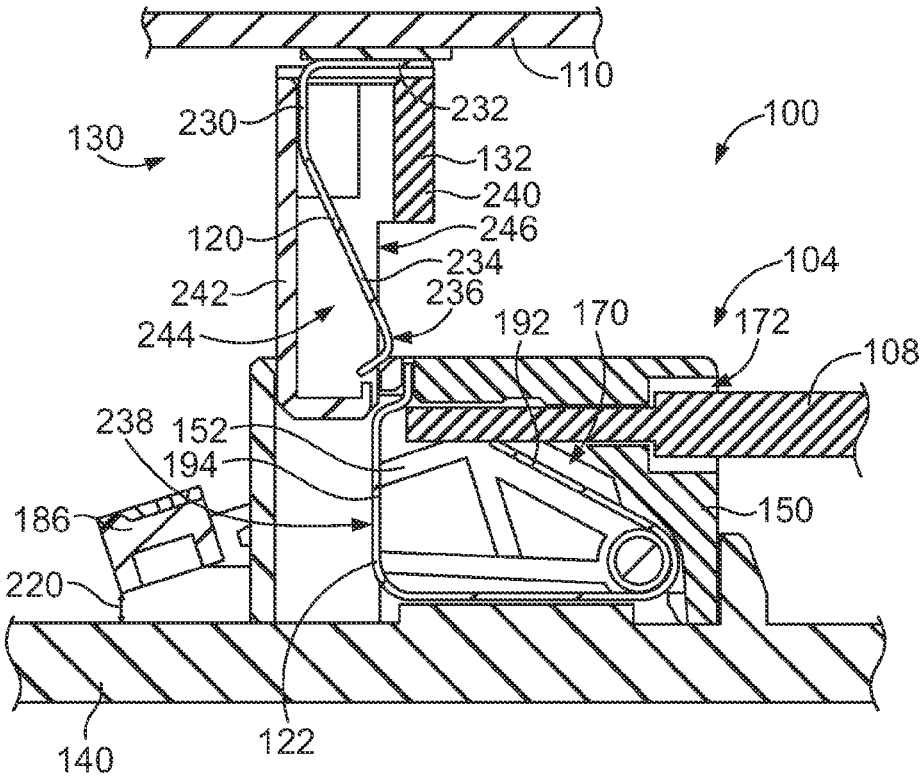
FIG. 6 is a cross-sectional view of the wall plate connector system showing a header assembly being coupled to the electrical connector.

FIG. 6 is a cross-sectional view of the wall plate connector system 100 showing the header assembly 130 being coupled to the electrical connector 104. The wire 108 is shown poked into the wire channel 172 terminated to the terminal contact 122 and the contact channel 170. When the wire 108 is poked into the wire channel 172, the poke-in spring beam 192 is deflected, causing the pivot lever 152 to pivot to a deflected position. In the deflected position, a gap 220 is formed between the release button 186 and the wall plate base 140. The gap 220 allows space for the pivot lever 152 to pivot to a released position to release the poke-in spring beam 192 from the wire 108 to allow the wire 108 to be removed from the wall plate terminal block 150.

The header contact 120 is received in the header block 132 such that the header contact 120 is configured to be mated to the header beam 194 of the terminal contact 122 when the header assembly 130 is coupled to the wall plate terminal block 150. The header contact 120 includes a main body 230 having a terminating end 232 and a mating beam 234 at a mating end opposite the terminating end 232. The mating beam 234 is configured to be electrically connected to the header beam 194. The terminating end 232 is configured to be electrically connected to the control circuit board 110. In the illustrated embodiment, the terminating end 232 is a solder pad soldered to the control circuit board 110. Other types of terminating ends may be provided in alternative embodiments, such as solder tails, compliant pins, spring beams, or other types of contacts. In the illustrated embodiment, the mating beam 234 is a spring beam configured to be resiliently deflected when mated with the header beam 194. Alternatively, the header beam 194 may define a spring beam configured to be resiliently deflected against the mating beam 234. The mating beam 234 defines a separable mating interface 236 and the header beam 194 defines a separable mating interface 238 configured for repeated mating and unmating at the separable mating interfaces 236, 238. The resiliently deflected mating beam 234 provides a large surface area for mating with the header beam 194, as compared to a pin, to ensure electrical contact between the header contact 120 and the terminal contact 122.

The header block 132 includes a main block 240 and a shroud 242 extending from the main block 240. The shroud 242 has a contact channel 244 that receives the header contact 120. The shroud 242 surrounds the contact channel 244 and the header contact 120 in the contact channel 244 to protect the header contact 120. For example, the entire mating beam 234 is surrounded by the shroud 242 along the rear, bottom and the sides thereof to provide protection from damage. The front of the shroud 242 includes an opening 246 that exposes the separable mating interface 236 of the mating beam 234. Only a small portion of the mating beam 234 may be exposed exterior of the shroud 242 to define the separable mating interface 236. When the mating beam 234 is mated with the header beam 194, the mating beam 234 may be pressed inward into the shroud 242. In an exemplary embodiment, the main body 230 and the distal end of the mating beam 234 are both contained within the shroud 242 and surrounded by the plastic material of the header block 132 to protect the mating beam 234 from damage.

Figure 7:
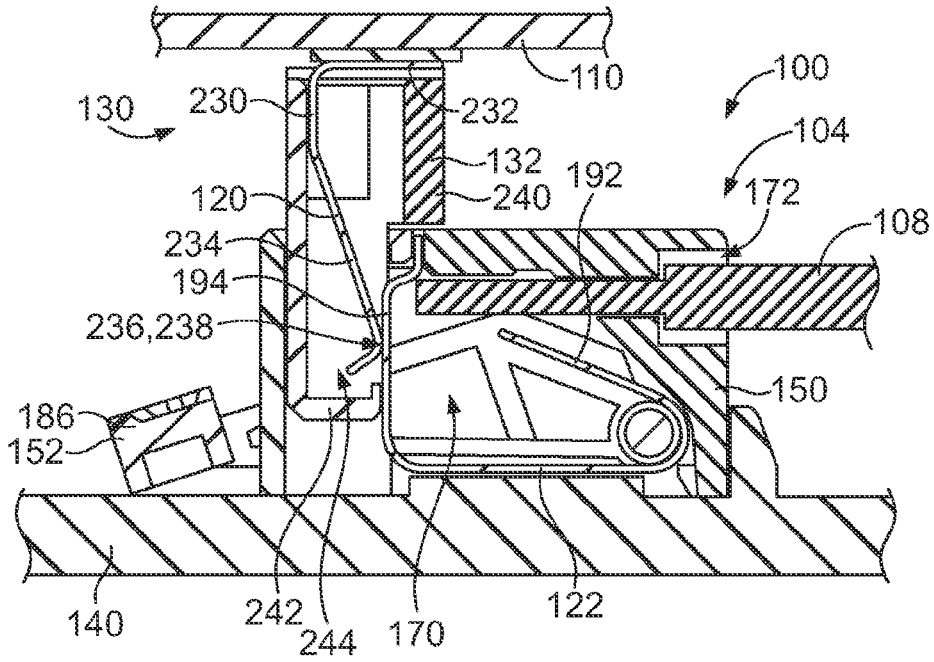
FIG. 7 is a cross-sectional view of the wall plate connector system showing the header assembly mated with the electrical connector.

FIG. 7 is a cross-sectional view of the wall plate connector system 100 showing the header assembly 130 mated with the electrical connector 104. The shroud 242 is fully loaded into the header channel 210. The mating beam 234 of the header contact 120 is mated with the header beam 194 of the terminal contact 122 and is resiliently deflected such that the mating beam 234 is spring biased against the header beam 194.

The pivot lever 152 is shown actuated or pressed to a released position. The release button 186 may be pressed until the release button 186 engages the wall plate base 140. As the pivot lever 152 pivots to the released position, the poke-in spring beam 192 is likewise moved from a capturing position (FIG. 6) to a releasing position. The poke-in spring beam 192 engages the wire 108 when in the capturing position (FIG. 6). The poke-in spring beam 192 is releasable from the wire 108 when the pivot lever 152 is moved to the released position. When the poke-in spring beam 192 is in the releasing position, the tip 196 is spaced apart from the wire 108 to allow the wire 108 to be removed from the wire channel 172 of the terminal block body 154.

Figure 8:
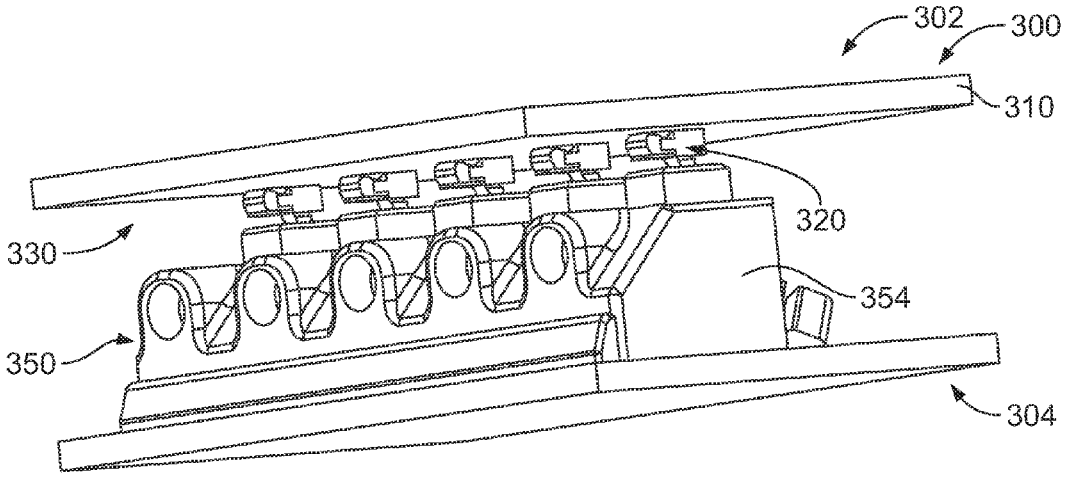
FIG. 8 is a perspective view of a wall plate connector system in accordance with an exemplary embodiment.
Figure 9:
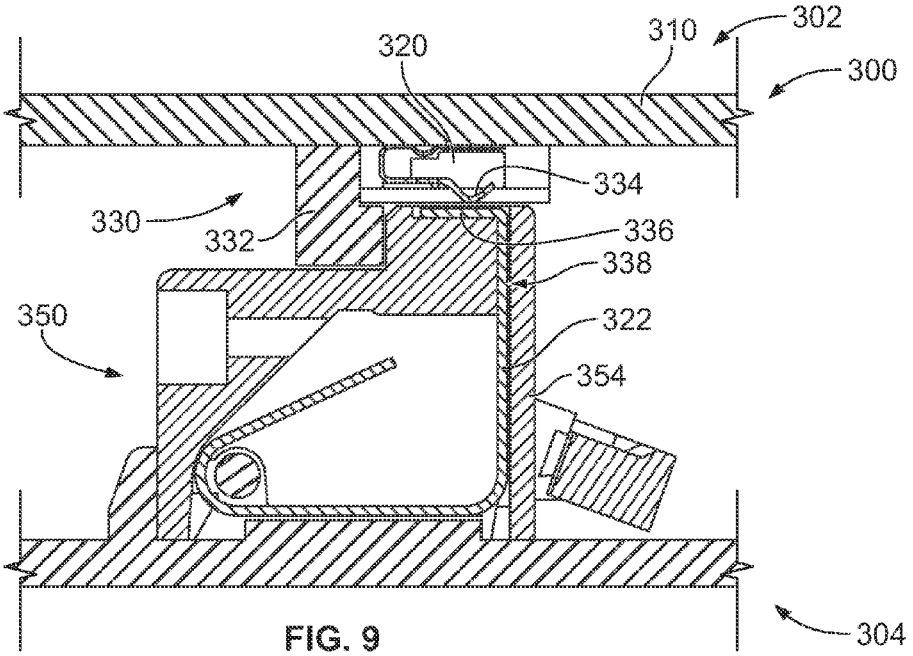
FIG. 9 is a cross-sectional view of the wall plate connector system shown in FIG. 8.

FIG. 8 is a perspective view of a wall plate connector system 300 having a control device 302 connected to an electrical connector 304 in accordance with an exemplary embodiment. FIG. 9 is a cross-sectional view of the wall plate connector system 300 showing the control device 302 connected to the electrical connector 304. The electrical connector 304 is similar to the electrical connector 104 (shown in FIG. 1) and the control device 302 is similar to the control device 102 (shown in FIG. 1). However, rather than having the control device plug into openings in the electrical connector, the control device 302 includes header contacts 320 terminated to terminal contacts 322 at a first and or exterior of the electrical connector 104. The header contacts 320 are not plugged into the electrical connector 304. The control device 302 may be mated in a linear mating direction, such as in a direction perpendicular to the wall, by plugging the control device 302 onto the electrical connector 304. Alternatively, the control device 302 may be mated in a linear mating direction, such as in a direction parallel to the wall, by sliding the control device 302 onto the electrical connector 304.

The control device 302 includes a header assembly 330 having a header block 332 (FIG. 9) holding the header contacts 320. The header block 332 is removed in FIG. 8 to illustrate the header contacts 320. The header contacts 320 are terminated to a control circuit board 310. The header contacts 320 include mating beams 334 that are configured to be mated to the terminal contacts 322. In the illustrated embodiment, the mating beams 334 are resiliently deflectable and define spring beams configured for repeated mating and unmating at a separable mating interface with the terminal contacts 322. The terminal contacts 322 each include a header beam 336 extending to the first end of the electrical connector 304. For example, the header beam 336 extends through an opening 338 in a terminal block body 354 of the wall plate terminal block 350. The header beam 336 is exposed at the first end of the terminal block body 354 for mating with the mating beam 334 of the header contacts 320. The header beam 336 may be loaded through the opening 338 and bent in place (e.g., bent 90°) to define a pad for the mating beam 334.

Figure 10:
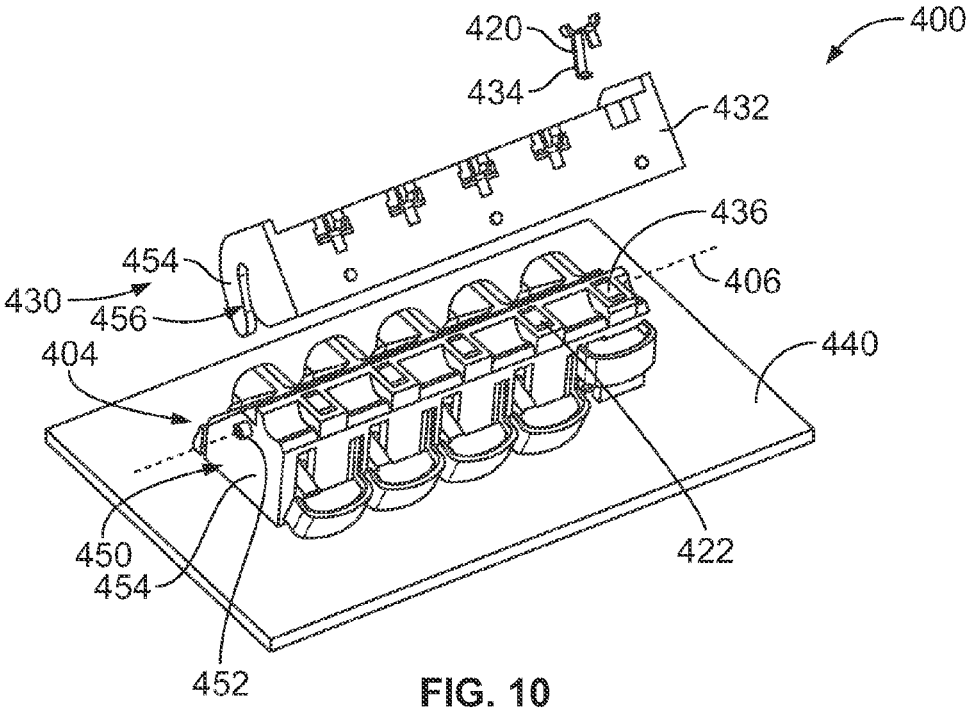
FIG. 10 is a perspective, exploded view of a wall plate connector system in accordance with an exemplary embodiment.
Figure 11:
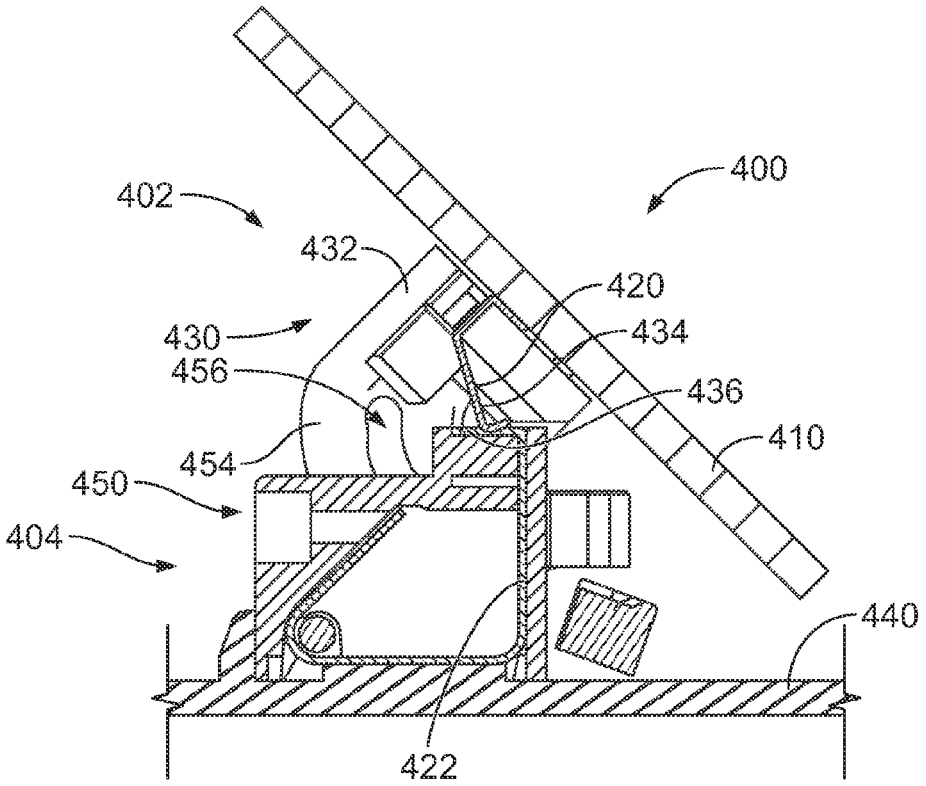
FIG. 11 is a cross-sectional view of the wall plate connector system shown in FIG. 10 showing a control device connected to an electrical connector in an unmated position.
Figure 12:
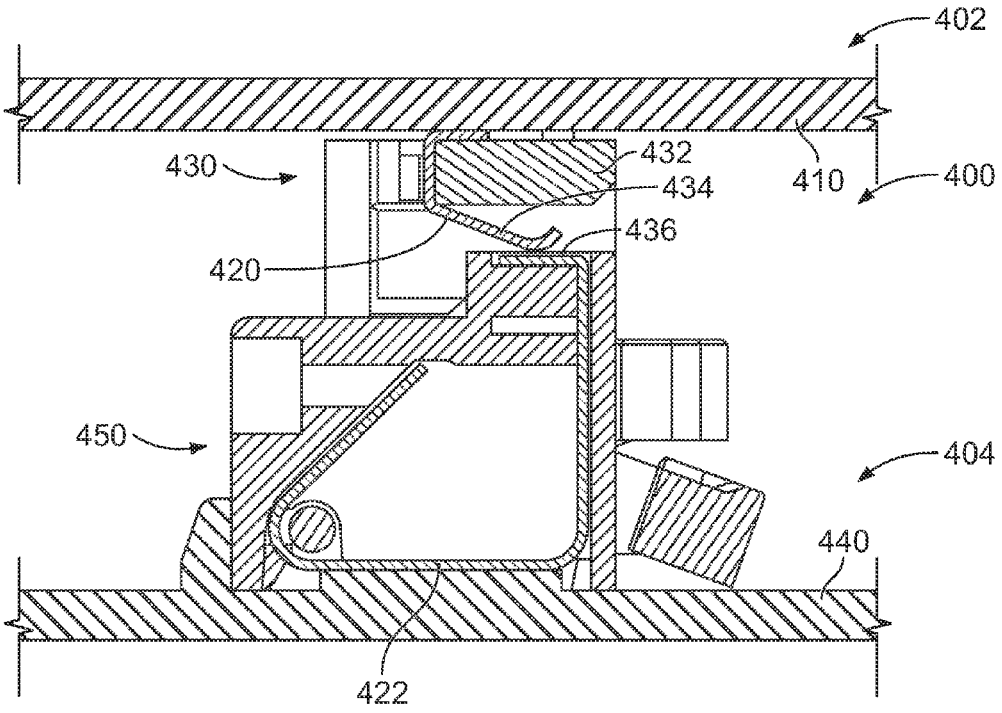
FIG. 12 is a cross-sectional view of the wall plate connector system showing a control device connected to an electrical connector in a mated position.
Figure 13:
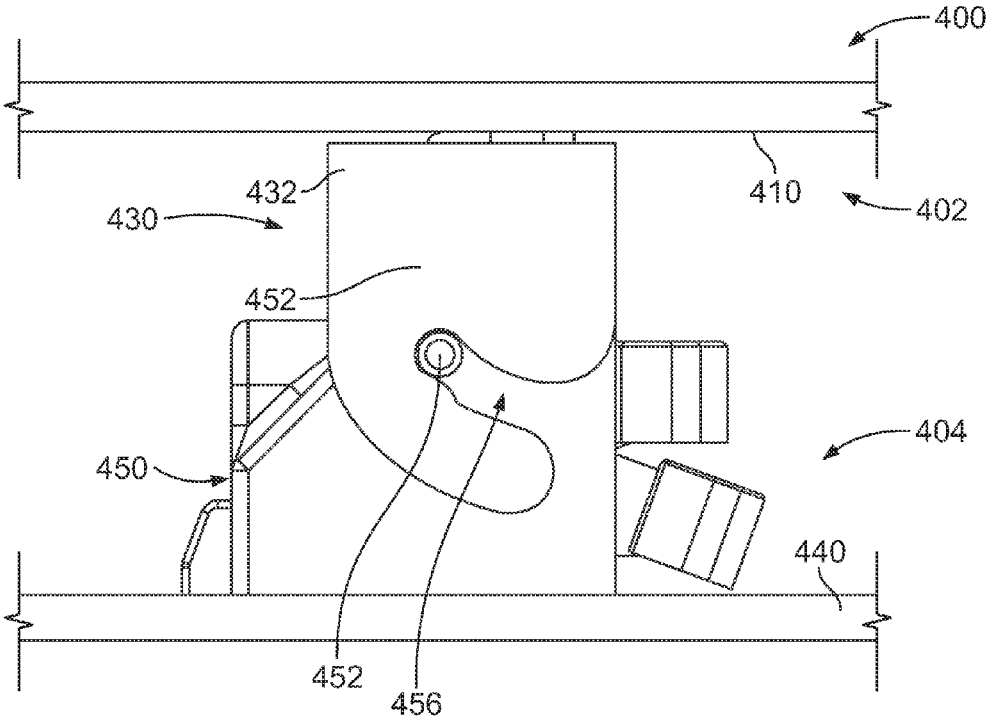
FIG. 13 is a side view of the wall plate connector system showing the control device connected to the electrical connector in the mated position.

FIG. 10 is a perspective, exploded view of a wall plate connector system 400 having a control device 402 connected to an electrical connector 404 in accordance with an exemplary embodiment. FIG. 11 is a cross-sectional view of the wall plate connector system 400 showing the control device 402 connected to the electrical connector 404 in an unmated position. FIG. 12 is a cross-sectional view of the wall plate connector system 400 showing the control device 402 connected to the electrical connector 404 in a mated position. FIG. 13 is a side view of the wall plate connector system 400 showing the control device 402 connected to the electrical connector 404 in the mated position. The electrical connector 404 is similar to the electrical connector 304 (shown in FIG. 8) and the control device 402 is similar to the control device 302 (shown in FIG. 8). However, rather than having the control device 402 mate with the electrical connector 404 in a linear mating direction, the control device 402 is rotated or pivoted from the unmated position (FIG. 11) to the mated position (FIG. 12). The control device 402 is rotated about a pivot axis 406, which, in the illustrated embodiment, is parallel to the wall and through the electrical connector 404.

The control device 402 includes a header assembly 430 having a header block 432 holding the header contacts 420 and a control circuit board 410 (removed in FIG. 10 to illustrate the header contacts 420). The header contacts 420 are terminated to the control circuit board 410. The header contacts 420 include mating beams 434 that are configured to be mated to the terminal contacts 422. In the illustrated embodiment, the mating beams 434 are resiliently deflectable and define spring beams configured for repeated mating and unmating at separable mating interfaces with the terminal contacts 422. The terminal contacts 422 each include a header beam 436 extending to the first end of the electrical connector 404 for mating with the mating beam 434 of the header contacts 420.

The electrical connector 404 includes a wall plate terminal block 450 having guideposts 452 extending from opposite sides of the terminal block 450. The guideposts 452 define the pivot axis 406. The header assembly 430 includes side walls 454 having guide slots 456. The guide slots 456 receive the guideposts 452 to guide mating of the header assembly 430 with the wall plate terminal block 450. The header assembly 430 is pivoted from the unmated position to the mated position about the guideposts 452. As the header assembly 430 is pivoted from the unmated position to the mated position, the header contacts 420 are resiliently deflected against the terminal contacts 422. The header contacts 420 may be spring biased against the terminal contact 422. In the unmated position, the control circuit board 410 is angled transverse to the wall and the corresponding wall plate base 440. As the header assembly 430 is rotated to the mated position, the control circuit board 410 is pivoted toward the wall plate base 440. In the mated position, the control circuit board 410 may be generally parallel to the wall and the wall plate base 440. Other orientations are possible in alternative embodiments.

Figure 14:
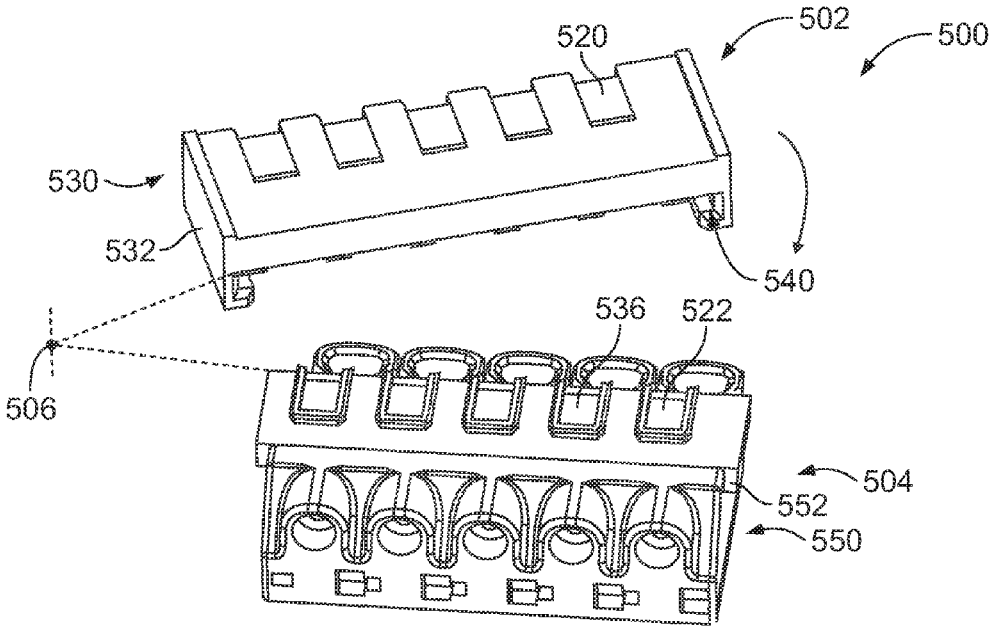
FIG. 14 is a perspective, exploded view of a wall plate connector system in accordance with an exemplary embodiment.
Figure 15:
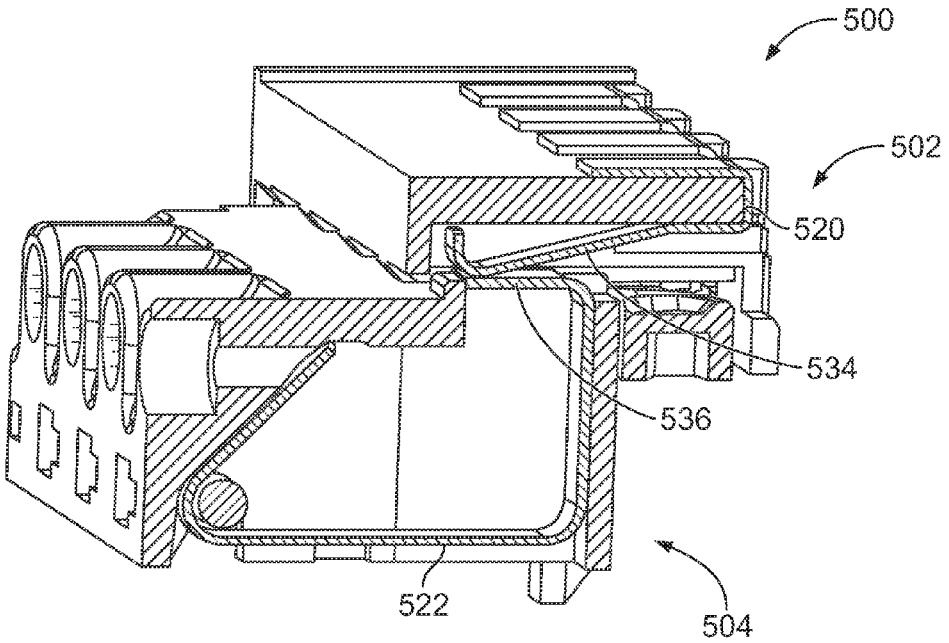
FIG. 15 is a cross-sectional view of the wall plate connector system shown in FIG. 14.

FIG. 14 is a perspective, exploded view of a wall plate connector system 500 having a control device 502 connected to an electrical connector 504 in accordance with an exemplary embodiment. FIG. 15 is a cross-sectional view of the wall plate connector system 500 showing the control device 502 connected to the electrical connector 504 in a mated position. The electrical connector 504 is similar to the electrical connector 304 (shown in FIG. 8) and the control device 502 is similar to the control device 302 (shown in FIG. 8).

The control device 502 may be mated in a linear direction, such as by sliding the control device 502 onto the electrical connector 504. In other various embodiments, the control device 502 may be rotated or pivoted from the unmated position (FIG. 14) to the mated position (FIG. 15). The control device 502 is rotated about a pivot axis 506, which, in the illustrated embodiment, is perpendicular to the wall and remote from both the electrical connector 504 and the control device 502. For example, the electrical connector 504 and the control device 502 may both be part of another device, such as a smoke detector (for example, the wall plate and the cover of the smoke detector), which is assembled by rotating the two pieces (wall plate and cover) to a mated position. The electrical connector 504 and the control device 502 may be offset from a center of rotation of the pieces, such as near the radially outer edges of the wall plate and the cover. The electrical connector 504 and the control device 502 may be mated as the cover is rotated onto the wall plate.

The control device 502 includes a header assembly 530 having a header block 532 holding the header contacts 520 and a control circuit board (not shown). The header contacts 520 may be terminated to the control circuit board. The header contacts 520 include mating beams 534 that are configured to be mated to the terminal contacts 522. In the illustrated embodiment, the mating beams 534 are resiliently deflectable and define spring beams configured for repeated mating and unmating at separable mating interfaces with the terminal contacts 522. The terminal contacts 522 each include a header beam 536 extending to the first end of the electrical connector 504 for mating with the mating beam 534 of the header contacts 520.

The header assembly 530 includes a keyway or track 540. The electrical connector 504 includes a wall plate terminal block 550 having a lip or rails 552 extending from opposite sides of the terminal block 550. The rails 552 are received in the track 540 to secure the header assembly 530 to the terminal block 550.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc., are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. A wall plate connector system comprising:

a wall plate base configured to be mounted to a wall having electrical wires associated with the wall;

a wall plate terminal block extending from the wall plate base, the wall plate terminal block includes a terminal block body having a front, a rear, a first end between the front and the rear and a second end between the front and the rear generally opposite the first end, the terminal block body having contact channels and wire channels open to corresponding contact channels, the wire channels being open at the front to receive a corresponding one of the electrical wires during a poke-in termination;

terminal contacts received in corresponding contact channels and held by a housing, each terminal contact comprising a poke-in spring beam configured to engage the electrical wire when poked-in to the corresponding wire channel, each terminal contact comprising a header beam remote from the poke-in spring beam, the header beam having a separable mating interface; and a header assembly removably coupled to the wall plate terminal block, the header assembly configured to be mounted to a control circuit board controlling the wall plate connector system, the header assembly having a header contacts configured to be terminated to the control circuit board, each header contact having a mating beam, the mating beam having a separable mating interface mated to the separable mating interface of the header beam of the corresponding terminal contact, wherein at least one of the mating beam and the header beam is a resiliently deflected spring beam configured for repeated mating and unmating at the separable mating interfaces.

2. The wall plate connector system of claim 1, wherein each mating beam is spring biased against the corresponding header beam.

3. The wall plate connector system of claim 1, wherein the header assembly includes a header block configured to be mounted to the control circuit board, the header block including contact channels holding the header contacts.

4. The wall plate connector system of claim 3, wherein the mating beam of each header contact extends from a base to a tip, the base and the tip being positioned in the contact channel.

5. The wall plate connector system of claim 3, wherein the header block includes shrouds defining corresponding contact channels and receiving corresponding header contacts, each shroud having an opening in a side thereof to expose the separable mating interface is therethrough.

6. The wall plate connector system of claim 1, wherein the header assembly is mated to the wall plate terminal block in a linear mating direction.

7. The wall plate connector system of claim 1, wherein the header assembly includes a guide slot and the wall plate terminal block includes a guidepost received in the guide slot to guide mating of the header assembly with the wall plate terminal block, the header assembly being pivoted from an unmated position to a mated position about the guidepost.

8. The wall plate connector system of claim 1, wherein the header assembly is rotated from an unmated position to a mated position in a plane generally parallel to and non-coplanar with the wall plate base about a point remote from the wall plate terminal block and remote from the header assembly.

9. The wall plate connector system of claim 1, wherein the terminal contacts are held, at least in part, in the contact channels by pivot levers pivotably coupled to the terminal block body, the pivot lovers being moved to move the poke-in spring beams and released electrical wires.

10. The wall plate connector system of claim 9, wherein the pivot levers have released buttons exposed at an exterior of the terminal block body.

11. The wall plate connector system of claim 1, wherein the terminal block body includes header channels configured to receive portions of the header assembly, the header beams being exposed in the header channels for mating with the mating beams of the header contacts.

12. The wall plate connector system of claim 1, wherein the header beams are exposed at the first end for mating engagement with the mating beams of the header contacts when the header assembly is mated with the wall plate terminal block.

13. A wall plate connector system comprising:

a wall plate base configured to be mounted to a wall having electrical wires associated with the wall;

a wall plate terminal block extending from the wall plate base, the wall plate terminal block includes a terminal block body having a front, a rear, a first end between the front and the rear and a second end between the front and the rear generally opposite the first end, the terminal block body having contact channels and wire channels open to corresponding contact channels, the wire channels being open at the front to receive a corresponding one of the electrical wires during a poke-in termination;

terminal contact assemblies received in corresponding contact channels and held by a housing, each terminal contact assembly comprising a terminal contact and a pivot lever holding the terminal contact, the pivot lever being pivotably coupled to the terminal block body, the pivot lever having a release button exposed at an exterior of the terminal block body, the terminal contact comprising a poke-in spring beam configured to engage the electrical wire when poked-in to the corresponding wire channel, the poke-in spring beam being releasable from the electrical wire when the pivot lever is moved to a releasing position, each terminal contact comprising a header beam remote from the poke-in spring beam, the header beam having a separable mating interface; and a header assembly removably coupled to the wall plate terminal block, the header assembly configured to be mounted to a control circuit board controlling the wall plate connector system, the header assembly having a header contacts configured to be terminated to the control circuit board, each header contact having a mating beam, the mating beam having a separable mating interface mated to the separable mating interface of the header beam of the corresponding terminal contact, wherein at least one of the mating beam and the header beam is a resiliently deflected spring beam configured for repeated mating and unmating at the separable mating interfaces.

14. The wall plate connector system of claim 13, wherein each mating beam is spring biased against the corresponding header beam.

15. The wall plate connector system of claim 13, wherein the header assembly includes a header block configured to be mounted to the control circuit board, the header block including contact channels holding the header contacts.

16. The wall plate connector system of claim 13, wherein the header assembly is mated to the wall plate terminal block in a linear mating direction.

17. The wall plate connector system of claim 13, wherein the header assembly includes a guide slot and the wall plate terminal block includes a guidepost received in the guide slot to guide mating of the header assembly with the wall plate terminal block, the header assembly being pivoted from an unmated position to a mated position about the guidepost.

18. The wall plate connector system of claim 13, wherein the header assembly is rotated from an unmated position to a mated position in a plane generally parallel to and non-coplanar with the wall plate base about a point remote from the wall plate terminal block and remote from the header assembly.

19. The wall plate connector system of claim 13, wherein the header beams are exposed at the first end for mating engagement with the mating beams of the header contacts when the header assembly is mated with the wall plate terminal block.

20. A wall plate connector system comprising:

a wall plate base configured to be mounted to a wall having electrical wires associated with the wall;

a wall plate terminal block extending from the wall plate base, the wall plate terminal block includes a terminal block body having a front, a rear, a first end between the front and the rear and a second end between the front and the rear generally opposite the first end, the terminal block body having contact channels and wire channels open to corresponding contact channels, the wire channels being open at the front to receive a corresponding one of the electrical wires during a poke-in termination;

terminal contact assemblies received in corresponding contact channels and held by a housing, each terminal contact assembly comprising a terminal contact and a pivot lever holding the terminal contact, the pivot lever being pivotably coupled to the terminal block body, the pivot lever having a release button extending from the rear and being movable to move the terminal contact between a capturing position and a releasing position, the terminal contact comprising a poke-in spring beam configured to engage the electrical wire when poked-in to the corresponding wire channel and when in the capturing position, the poke-in spring beam being releasable from the electrical wire when the pivot lever is moved to the releasing position, each terminal contact comprising a header beam remote from the poke-in spring beam, the header beam having a separable mating interface configured for mating with a header contact of a header assembly.

* * * * *